US008052541B2

(12) United States Patent
Ross

(10) Patent No.: US 8,052,541 B2
(45) **Date of Patent: *Nov. 8, 2011**

(54) GOLF CLUB FOR GOLFER ALIGNMENT

(76) Inventor: Stephen T. Ross, Medina, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/047,452

(22) Filed: Mar. 14, 2011

(65) Prior Publication Data

US 2011/0212792 A1 Sep. 1, 2011

Related U.S. Application Data

(63) Continuation of application No. 12/017,233, filed on Jan. 21, 2008, now Pat. No. 7,905,794.

(51) Int. Cl.
*A63B 69/36* (2006.01)
*A63B 53/04* (2006.01)

(52) U.S. Cl. ..... 473/250; 473/251; 473/253; 473/254; 473/328; 473/340; 273/DIG. 14

(58) Field of Classification Search ..... 473/219–256, 473/313, 340, 341; D21/736–746, 751, 759; 273/DIG. 14
See application file for complete search history.

(56) References Cited

U.S. PATENT DOCUMENTS

| | | | | | |
|---|---|---|---|---|---|
| 3,019,022 | A * | 1/1962 | Ehmke | 473/240 |
| 3,637,218 | A * | 1/1972 | Carlino | 473/325 |
| 3,866,922 | A * | 2/1975 | Marci et al. | 473/250 |
| 3,880,430 | A * | 4/1975 | McCabe | 473/253 |
| 4,136,877 | A * | 1/1979 | Antonious | 473/254 |
| 4,138,117 | A * | 2/1979 | Dalton | 473/255 |
| 4,222,566 | A * | 9/1980 | Berry | 473/250 |
| 4,343,472 | A * | 8/1982 | Hamilton | 473/240 |
| 4,369,974 | A * | 1/1983 | Komperda | 473/250 |
| 4,508,342 | A * | 4/1985 | Drake | 473/204 |
| 4,749,196 | A * | 6/1988 | Podgor | 473/250 |
| 4,871,174 | A * | 10/1989 | Kobayashi | 473/252 |
| 5,433,444 | A * | 7/1995 | Chiuminatta et al. | 473/240 |
| 5,846,140 | A * | 12/1998 | Hoburg | 473/240 |
| 7,052,409 | B2 * | 5/2006 | Goldsmith | 473/242 |
| 7,083,525 | B2 * | 8/2006 | Pond et al. | 473/251 |
| 7,101,288 | B2 * | 9/2006 | Thomas | 473/242 |
| 7,226,362 | B1 * | 6/2007 | Schell et al. | 473/238 |
| 7,611,419 | B2 * | 11/2009 | O'Neill | 473/242 |
| 7,905,794 | B2 * | 3/2011 | Ross | 473/250 |
| 2006/0040762 | A1 * | 2/2006 | Chupka et al. | 473/293 |

* cited by examiner

*Primary Examiner* — Sebastiano Passaniti
(74) *Attorney, Agent, or Firm* — McDonnell Boehnen Hulbert & Berghoff LLP

(57) ABSTRACT

A golf club that positions a golfer to establish a desired viewpoint of a golf ball when preparing to strike the golf ball with the golf club. The golf club includes an elongated shaft, a grip provided adjacent to a proximate end of the shaft that the golfer grips to hold the golf club while striking the golf ball during a golf swing, and a club head coupled adjacent to a distal end of the shaft and including a face exposed at a surface of the head for contacting the golf ball during the golf swing. A visual indicator is provided to the club head, wherein the visual indicator is observable by the golfer to indicate that the golfer is positioned in at least one of a predetermined longitudinal direction relative to the club head and a predetermined lateral direction relative to the club head to afford the golfer the desired viewpoint of the golf ball before striking the golf ball.

1 Claim, 7 Drawing Sheets

GOLF CLUB FOR GOLFER ALIGNMENT

CROSS REFERENCE TO RELATED APPLICATIONS

The present application is a continuation of U.S. patent application Ser. No. 12/017,233 filed on Jan. 21, 2008, now U.S. Pat. No. 7,905,794, the entire contents of which are incorporated herein by reference.

FIELD OF THE INVENTION

This application relates generally to a method and apparatus for establishing a desired position of a golfer relative to a ball.

More specifically, this application relates to a method and golf club provided with visually perceptible indicia to indicate a proper position of a golfer that is holding the golf club relative to a golf ball to be struck by the golf club.

BACKGROUND

Typically, a golfer approaches a golf ball on the ground and addresses it by going through a routine that seeks to properly position the golfer relative to the ball, and establish the golfer's concentration before swinging the golf club. Take, for example, addressing a golf ball on a putting green before putting. It is desirable for the golfer to position his head vertically above the ball so as to have an accurate view of the intended ball path towards the target. So positioning the golfer's eyes during a putt will also facilitate striking the ball with the club face of the putter substantially perpendicular to the ball at the point of contact and with the club head traveling along the desired line of travel from the ball to the target. If the golfer's head is horizontally offset from a point vertically above the ball within a plane that is parallel to the ground, it will be difficult for the golfer to observe the line along which the ball should travel to reach the intended target, thereby making it difficult for the golfer to aim and make the putt.

Good golfers are also able to consistently reproduce their swing and alignment relative to the ball to produce predictable results. By consistently reproducing the swing and alignment relative to the ball, such golfers can make minor corrections to their relative alignment upon producing an undesirable result with a previous swing. However, the minor corrections must be made relative to a known starting point, which depends on being able to consistently approach the ball over and over again.

Further, the path along which the club head travels as it is being swung resembles the path of a swinging pendulum. The golfer's upper torso and head acts as a central point about which the club head travels en route to striking the ball with the club face. As the club head is drawn back during the backswing, the club head follows an arc about the central point as it rises back and from the ground until reaching what is referred to as the "top" of the backswing. After reaching the top of the backswing, the club head begins to travel along its return path downward along the arc toward the ball. If the golfer's head is misaligned relative to the ball, the club head will likely not be at or near the bottom of the arc when the club face makes contact with the ball. Striking the ball while the club head is in a steep descent along the arc returning from the top of the backswing, or conversely, striking the ball while the club head is in a steep ascent after passing the bottom of the arc will cause the ball to become airborne. When the ball becomes airborne it can respond unpredictably when it returns to the surface of the putting green, thereby minimizing the golfer's control over the ball.

Accordingly, there is a need in the art for a method and apparatus that promotes consistent and precise alignment of a golfer relative to a ball when making preparations to strike the ball. The method and apparatus can be employed while the golfer is participating in a round of golf, or while the golfer is at a practice facility, and includes displaying a visually perceptible indication of an appropriate position of the golfer relative to the ball.

SUMMARY

According to one aspect, the present invention provides a golf club for positioning a golfer to establish a desired viewpoint of a golf ball when preparing to strike the golf ball with the golf club. The golf club includes an elongated shaft, a grip provided adjacent to a proximate end of the shaft that the golfer grips to hold the golf club while striking the golf ball during a golf swing, and a club head coupled adjacent to a distal end of the shaft and including a face exposed at a surface of the head for contacting the golf ball during the golf swing. A visual indicator is provided to the club head, wherein the visual indicator is observable by the golfer to indicate that the golfer is positioned in at least one of a predetermined longitudinal direction relative to the club head and a predetermined lateral direction relative to the club head to afford the golfer the desired viewpoint of the golf ball before striking the golf ball.

According to another aspect, the present invention provides a putter for positioning a golfer to establish a desired viewpoint of a golf ball resting on a putting surface when preparing to putt the golf ball with the putter. The putter includes an elongated shaft, a grip provided adjacent to a proximate end of the shaft that the golfer grips to hold the golf club while putting the golf ball, and a putter head coupled adjacent to a distal end of the shaft and including a face having a loft of about 10.degree. from vertical or less exposed at a surface of the putter head for contacting the golf ball during a putt. A visual indicator is provided to the putter head, wherein the visual indicator is observable by the golfer to indicate that the golfer is positioned in a longitudinal direction relative to the putter head and a lateral direction relative to the putter head to afford the golfer the desired viewpoint of the golf ball before putting the golf ball. The desired viewpoint is achieved when the golfer's view of the golf ball is aligned in both the longitudinal direction and the lateral direction to provide a substantially vertical view down onto the golf ball when the golfer is positioned to putt the golf ball.

According to another aspect, the present invention provides a putter for positioning a golfer to establish a desired viewpoint of a golf ball resting on a putting surface when preparing to putt the golf ball with the putter. The putter includes an elongated shaft, a grip provided adjacent to a proximate end of the shaft that the golfer grips to hold the golf club while putting the golf ball, and a putter head coupled adjacent to a distal end of the shaft and including a face having a loft of about 5.degree. from vertical or less exposed at a surface of the putter head for contacting the golf ball during a putt. The putter also includes means for providing a visual indication to the golfer provided to the club head, wherein the means for providing the visual indication is observable by the golfer to indicate that the golfer is positioned in a predetermined longitudinal direction relative to the club head and a predetermined lateral direction relative to the club head to afford the golfer the desired viewpoint of the golf ball before putting the golf ball.

According to another aspect, the present invention provides a putter for providing a golfer with a visual indication of an initial path along which a golf ball will travel relative to a target on a putting surface upon being struck by the putter during a putt. The putter includes an elongated shaft, a grip provided adjacent to a proximate end of the shaft that the golfer grips to hold the putter while putting the golf ball, and a putter head coupled adjacent to a distal end of the shaft and including a face having a loft that is less than or equal to about 10.degree. from vertical exposed at a surface of the putter head for contacting the golf ball during a putt. A substantially transparent portion is provided to the putter for presenting a view of the golf ball to the golfer, and a visible marking can be aligned with the golf ball while the golfer is observing the view of the golf ball to indicate to the golfer the initial path along which the golf ball will travel upon being struck by the face of the putter head.

BRIEF DESCRIPTION OF THE FIGURES

The invention may take physical form in certain parts and arrangement of parts, embodiments of which will be described in detail in this specification and illustrated in the accompanying drawings which form a part hereof and wherein.

DETAILED DESCRIPTION

Figure 1:
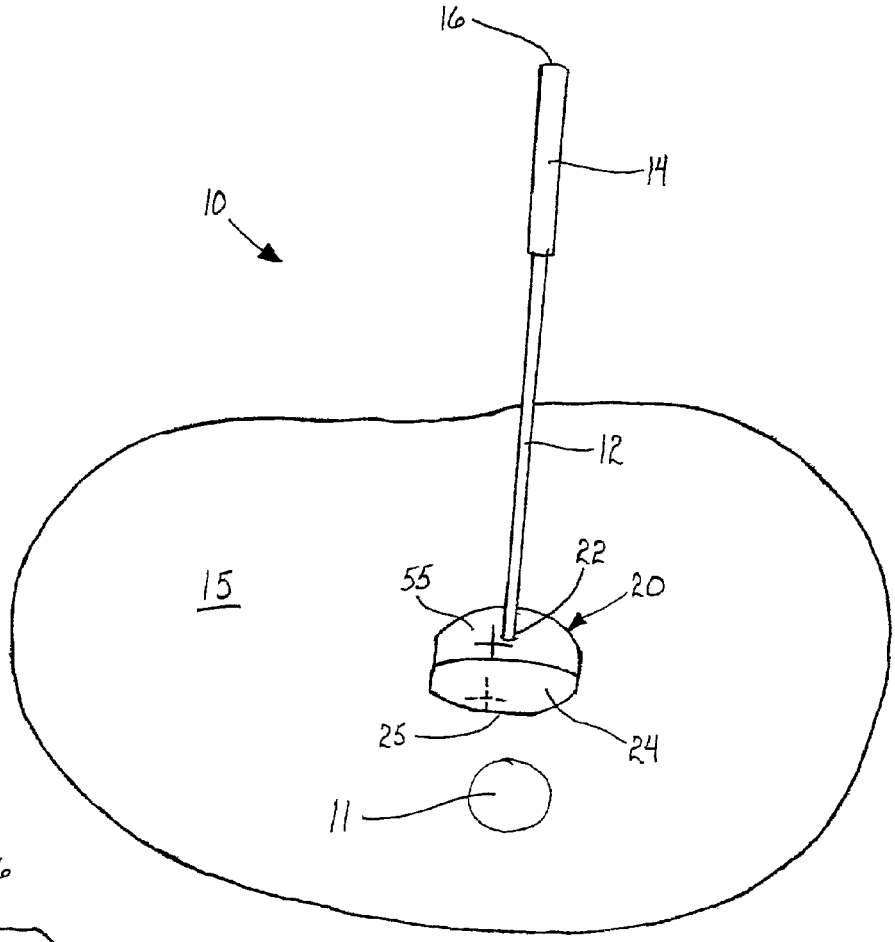
FIG. 1 shows a perspective view of an illustrative embodiment of a golf club.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

FIG. 1 is a perspective view of an illustrative golf club 10 according to an embodiment of the present invention. As shown, the golf club 10 is a putter, but the present invention is not so limited, and can include any golf club 10 used in the game of golf. However, for the sake of clearly describing the present invention, the example of the golf club 10 in the form of a putter 10 will be described in detail below.

The putter 10 is for positioning a golfer (not shown) to establish a desired viewpoint of a golf ball 11 resting on a putting surface 15 or other ground when preparing to strike the golf ball with the putter 10. The putter 10 includes an elongated shaft 12 formed from a suitably rigid material such as aluminum, steel, graphite, or a combination thereof. A grip 14 provided adjacent to a proximate end 16 of the shaft 12 is gripped by the golfer to hold the putter 10 while striking the golf ball 11 during a golf swing, which in the present example, is putting. The grip 14 can be any conventional grip that offers the golfer a padded, non-slip handle to grasp when holding the putter 10. Chords (not shown) or any other traction enhancing feature can optionally be provided to the grip 14 to minimize slippage of the putter 10 in the hands of the golfer.

A club head 20, which is a putter head 20 in FIG. 1, is coupled adjacent to a distal end 22 of the shaft 12 and includes a face 24 exposed at a surface of the putter head 20 for making contact with the golf ball 11 during a putt. For embodiments where the golf club 10 is a putter 10, the face 24 of the putter head 20 forms an angle from a vertical orientation that provides the putter head 20 with a loft of about 5.degree. or less when a portion of a bottom surface 25 of the putter head 20 is rested flat on a horizontal putting surface 15 or other horizontal portion of ground. Thus, when the golf ball 11 is struck during a putt, the golf ball 11 rolls over the putting surface 15 a majority of the distance the golf ball 11 travels en route to the target, which as described below, is the hole 88. The degrees of loft refer to the angle that the face 24 forms relative to a vertical orientation. According to other embodiments, the putter head 20 is provided with a face 24 that has about 10.degree. or less of loft, about 9.degree. or less of loft, about 8.degree. or less of loft, about 7.degree. or less of loft, 6.degree. or less of loft, about 5.degree. or less of loft, about 4.degree. or less of loft, about 3.degree. or less of loft, about 2.5.degree. or less of loft, about 2.degree. or less of loft, and so on. The face 24 can also optionally support a material that is different than the material from which a predominant portion of the putter head 20 is formed, to establish a desired impact between the golf ball 11 and the putter head 20. For example, a layer of a polymeric substance can be exposed at the face 24 to soften the impact between the golf ball 11 and the putter head 20, and to minimize slip there between.

Figure 2:
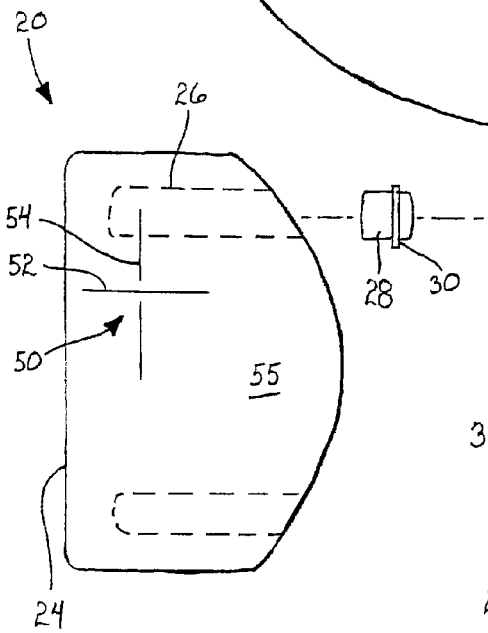
FIG. 2 shows a top view looking down onto a club head provided to a golf club according to an illustrative embodiment.

As shown in FIG. 2, the putter head 20, includes a generally rounded shape that is truncated at an end to form the face 24. The face 24 is generally planar, and makes contact with the golf ball 11 as the putter 10 is swung by the golfer during a putt. According to alternate embodiments, the putter head 20 can optionally include one or more receivers 26, shown as hidden lines in FIG. 2, that are bored, molded, or otherwise formed in the putter head 20 to releasably couple a weight to the putter head 20 for varying the weight, balance, or weight and balance of the putter head 20 to suit the golfer's preferences. As shown in FIG. 2, two receivers 26 in the form of internal passages are formed in the putter head 20. One or more weights 28 can optionally be received within either or both internal passages forming the receivers 26, and releasably secured therein by an annular washer 30 formed from a rubber or other pliable material that interacts with an interior surface of the receiver 26.

Figure 3:
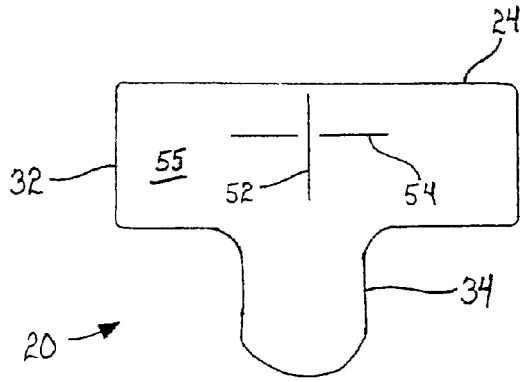
FIG. 3 shows a top view looking down onto a club head provided to a golf club according to an alternate illustrative embodiment.

Although shown in FIG. 2 as having a truncated, generally arcuate shape, the putter head 20 can have any desired shape that includes a face 24 that makes contact with the golf ball 11 as the putter 10 is swung during a putt. For example, an alternate shape suitable for a putter head 20 is illustrated in FIG. 3. According to such an illustrative embodiment, the putter head 20 includes a generally rectangular footprint 32 when viewed from above, also including a rounded rectangular protrusion 34 extending at an approximate right angle from the side of the putter head 20 opposite the face 24. The putter head 20 can also be formed to include any other suitable footprint without departing from the scope of the present invention.

When addressing a golf ball 11 in preparation of striking the golf ball 11 with the putter 10 or other golf club, the golfer adjusts the position of his or her feet 36 relative to the golf ball 11 to position themselves in a suitable position to strike the golf ball 11 with a particular golf club. For the embodiments where the golf club is the putter 10, the golfer seeks to position his or her feet to stand next to the golf ball 11 with their eyes located substantially vertically and directly above the golf ball 11, giving the golfer a desired viewpoint of the golf ball 11 for using the putter 10. Such a position allows the putter head 20, when swinging in a pendulum motion during a putt, to contact the golf ball 11 at or near the bottom of the swing when the putter head 20 is traveling substantially parallel to the putting surface 15. To achieve such a position, the golfer adjusts the position of his or her feet 36 in fore or aft directions as indicated by arrows 38, in a lateral direction as indicated by arrows 40, or in both a fore or aft direction as well as a lateral direction relative to the golf ball 11. As described herein and used in the attached claims, adjustments by the golfer in the fore and aft directions 38 will be referred to as corresponding to adjustments in a longitudinal direction relative to the golf ball 11, while adjustments by the golfer in either of the lateral directions 40 will be referred to as corresponding to adjustments in a lateral direction relative to the golf ball 11. In other words, adjustments of the golfer's feet 36 in the longitudinal directions indicated by arrows 38 causes the golfer's position, including the position of the golfer's eyes, to be adjusted in a direction that is substantially perpendicular to the path the golf ball will initially travel during a putt, an example of said path being illustrated in FIG. 4 by arrow 42. In contrast, adjustments of the golfer's feet 36 in a lateral direction indicated by arrows 40 will cause the golfer's position, including the position of the golfer's eyes, to be adjusted in a direction that is substantially parallel to the initial path 42 of the golf ball during a putt.

Although the longitudinal and lateral directions 38, 40 are described above relative to the golf ball 11, the same terminology applies equally relative to the putter head 20. Thus, when the putter head 20 is placed adjacent to the golf ball 11 as described in detail below, adjustments of the golfer's feet 36 relative to the golf ball 11 are also made relative to the putter head 20.

Referring once again to FIGS. 2 and 3, a visual indicator 50 is provided to the club head, wherein the visual indicator 50 is observable by the golfer to indicate that the golfer is positioned in at least one of a predetermined longitudinal direction 38 relative to the club head 20 and a predetermined lateral direction 40 relative to the club head 20 to afford the golfer the desired viewpoint of the golf ball 11 before putting or otherwise striking the golf ball 11 with the putter head 20. As shown in the embodiments in FIGS. 2 and 3, the visual indicator 50 includes a first longitudinal alignment indicator 52 and a first lateral alignment indicator 54 arranged in a crosshair-type arrangement. The first longitudinal and lateral alignment indicators 52, 54 are displayed adjacent to, or at the top surface 55 of the putter head 20 from where it can be observed by the golfer. The top surface 55 of the putter head 20 is the uppermost surface of the putter head 20 when the putter 10 is being grasped by the grip 14 as during a putt by the golfer.

Figure 5:
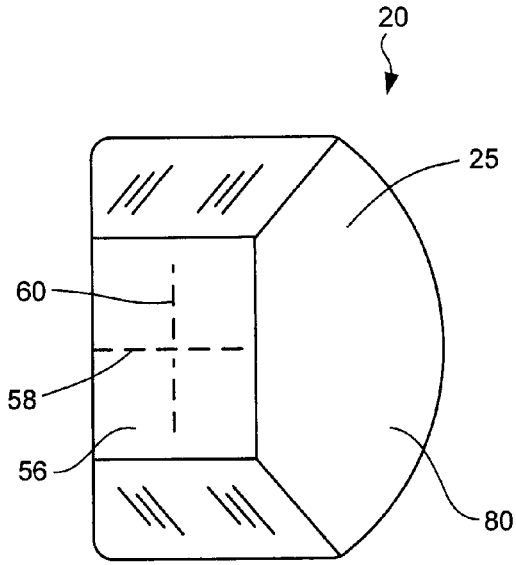
FIG. 5 shows an example layout of a bottom surface of a putter head according to an illustrative embodiment.

FIG. 5 shows a bottom view of an illustrative embodiment of the putter head 20. As shown, the bottom surface 25 of the putter head 20 includes a substantially planar region 56 that is to be rested on the putting surface 15 to establish a predetermined orientation of the putter head 20 relative to the putting surface 15 while so resting. The embodiment of the visual indicator 50 shown in FIGS. 1-3 and 5 also includes a second longitudinal alignment indicator 58 and a second lateral alignment indicator 60. The second longitudinal and lateral alignment indicators 58, 60 are shown in broken lines simply to differentiate those indicators from the first longitudinal and lateral alignment indicators 52, 54 in the figures. Both the first longitudinal and lateral alignment indicators 52, 54 and the second longitudinal and lateral alignment indicators 58, 60 can be any visually perceptible markers such as lines, dashes, dots and circles for example, that can be viewed by the golfer to indicate when the golfer has achieved a desired viewpoint of the golf ball 11 as described below. The second longitudinal and lateral alignment indicators 58, 60 are displayed adjacent to, or at the bottom surface 25 of the putter head 20 from where they can be observed by the golfer. As previously mentioned, the bottom surface 25 of the putter head 20 is the lowermost surface of the putter head 20 that can rest on the putting surface 15 while the golfer is grasping the grip 14 as is common during a putt by the golfer.

As shown best in FIG. 1, the putter head 20, or at least a portion thereof can be made of a substantially transparent material such as polycarbonate, for example. According to alternate embodiments, a substantially transparent window is formed in a putter head 20 that is not made entirely from the substantially transparent material. But regardless of the extent to which the putter head 20 is made from the substantially transparent material, the golfer can visually view both the first longitudinal and lateral alignment indicators 52, 54 and the second longitudinal and lateral alignment indicators 58, 60 while holding the putter 10 by the grip 14 and looking down onto the putter head 20 when addressing the golf ball 11 on the putting surface 15 in preparing to make a putt. Thus, for the embodiment shown in FIG. 1, the golfer can look through the substantially transparent putter head 20 to view both the first longitudinal and lateral alignment indicators 52, 54 and the second longitudinal and lateral alignment indicators 58, 60 as overlapping markers due to the different depths at which those indicators 52, 54 and 58, 60 are provided to the putter head 20.

Figure 4:
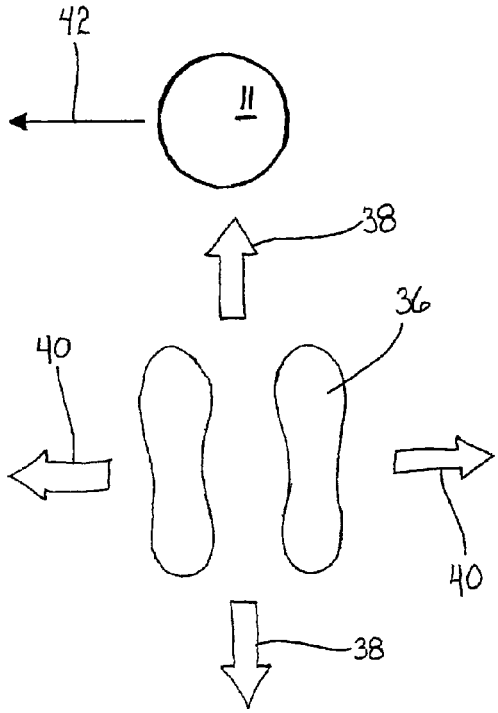
FIG. 4 shows an illustrative arrangement of a golf ball relative to a golfer's feet when addressing the golf ball before making a putt, wherein the golfer can adjust his or her position in a longitudinal direction, a lateral direction or both a longitudinal direction and a lateral direction to achieve a desired viewpoint of the golf ball to accurately and precisely align the putt.

Utilization of the visual indicator 50 to indicate to a golfer when that golfer has achieved a desired viewpoint of the golf ball 11 while standing over the golf ball 11 in a stance resembling that in FIG. 4 will be described next with reference to FIGS. 6-12. When addressing the golf ball 11 resting on the putting surface 15 in preparation of making a putt, the golfer aligns the face 24 of the putter head 20 to be substantially perpendicular to the desired path the golf ball 11 will travel upon being struck by the face 24 of the putter head 20. The bottom surface 25 of the putter head 20 is rested on the putting surface 15 adjacent to the golf ball 11 such that a substantial portion, if not all of the flat region 56 is in contact with the putting surface 15. Since the flat region 56 has a predetermined orientation relative to the putter head 20, the putter head 20 as a whole has a predetermined orientation relative to the golfer when the bottom surface 25 is resting on the putting surface 15. This predetermined orientation of the putter head 20 is such that the first longitudinal and lateral alignment indicators 52, 54 and the second longitudinal and lateral alignment indicators 58, 60 are substantially aligned, appearing as a single crosshair when the golfer's eyes are vertically above the golf ball 15 on the putting surface 15, thus achieving the desired viewpoint for aiming and making a putt.

Figure 6:
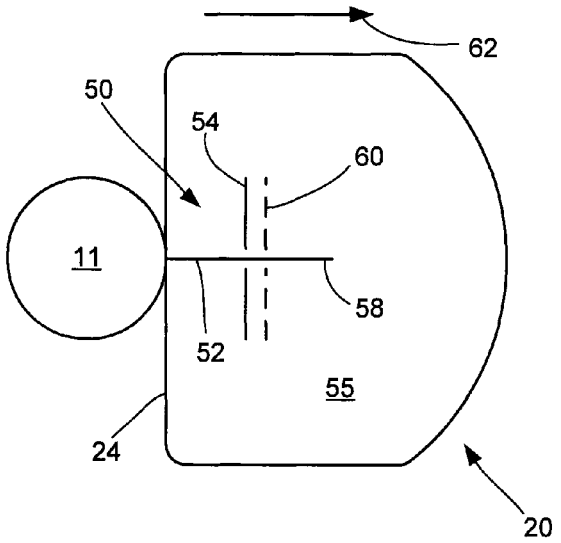
FIG. 6 shows a top surface of a putter head illustrating an example of a visual indicator indicating to a golfer that a desired viewpoint of a golf ball on a putting surface has not been achieved, and that adjustment of the golfer's position relative to the golf ball in a lateral direction is required to achieve the desired viewpoint.

Unless the visual indicator 50 indicates to the golfer that the desired viewpoint has been achieved, the visual indicator 50 can indicate that an adjustment of the golfer's position is appropriate, and can also optionally indicate the direction of the adjustment required to let the golfer achieve the desired viewpoint of the golf ball 11. In FIG. 6, the putter head 20 has been rested on the putting surface 15 and the golfer looks down onto the top surface 55 of the putter head 20 as shown. From this position, the golfer is positioned too far in a first lateral direction indicated by arrow 62, meaning that the golfer's eyes are positioned at least partially behind the golf ball 11, considering the portion of the golf ball 11 adjacent to the face 24 of the putter head 20 to be the back of the golf ball 11. If the golfer's eyes are at least partially behind the golf ball 11, this means that the golf ball 11 is disposed between the golfer's eyes and the hole in the putting surface 15 that the golfer is aiming for, assuming a flat putting surface 15. The visual indicator 50 indicates this undesirable position to the golfer since the second lateral alignment indicator 60 is observed by the golfer through the substantially transparent portion of the putter head 20 to be offset laterally to the right of the first lateral alignment indicator 54 as shown in FIG. 6. Thus, the golfer can deduce that a lateral adjustment of his or her position in a lateral direction opposite the direction of arrow 62 is appropriate to achieve the desired viewpoint of the golf ball 11.

Figure 7:
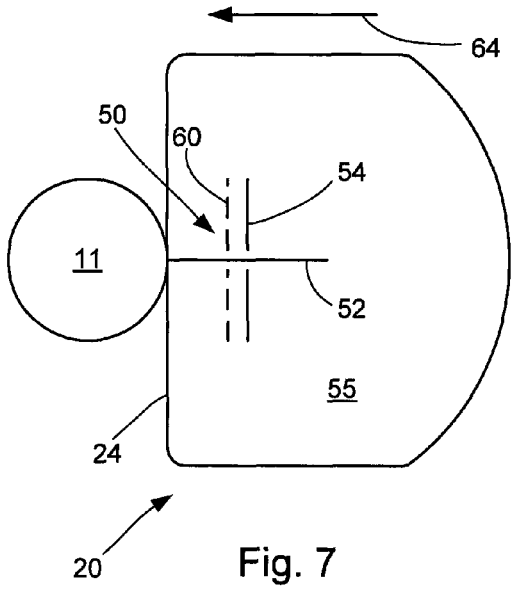
FIG. 7 shows a top surface of a putter head illustrating an example of a visual indicator indicating to a golfer that a desired viewpoint of a golf ball on a putting surface has not been achieved, and that adjustment of the golfer's position relative to the golf ball in a lateral direction is required to achieve the desired viewpoint.
Figure 8:
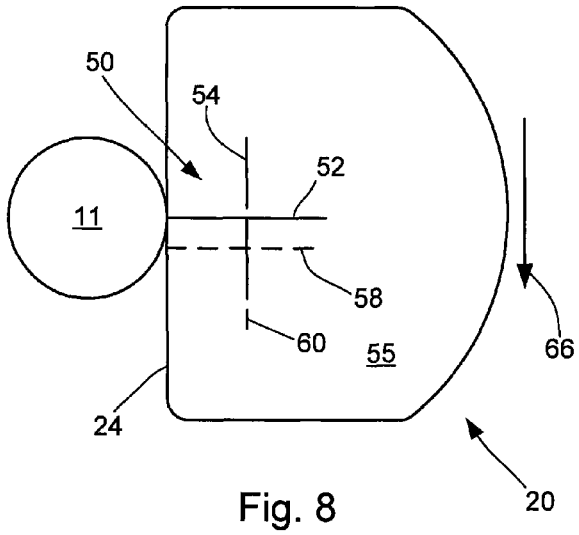
FIG. 8 shows a top surface of a putter head illustrating an example of a visual indicator indicating to a golfer that a desired viewpoint of a golf ball on a putting surface has not been achieved, and that adjustment of the golfer's position relative to the golf ball in a longitudinal direction is required to achieve the desired viewpoint.
Figure 9:
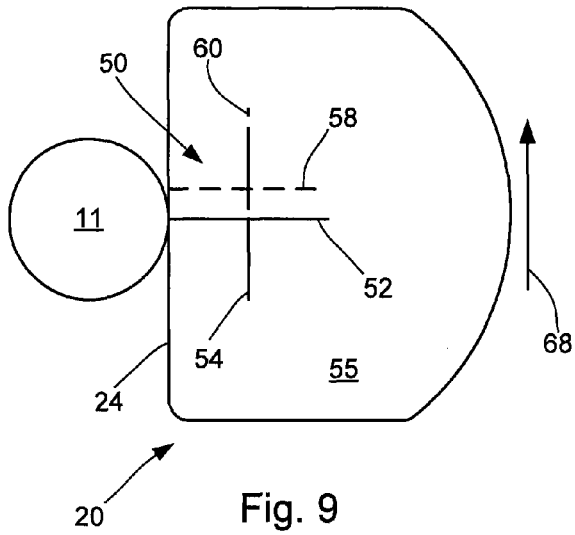
FIG. 9 shows a top surface of a putter head illustrating an example of a visual indicator indicating to a golfer that a desired viewpoint of a golf ball on a putting surface has not been achieved, and that adjustment of the golfer's position relative to the golf ball in a longitudinal direction is required to achieve the desired viewpoint.

If the golfer, upon looking down on the top surface 55 of the putter head 20 observes through the substantially transparent portion that the second lateral alignment indicator 60 appears to the left of the first lateral alignment indicator 54, as shown in FIG. 7, then the golfer can realize that he or she is positioned too far in a lateral direction indicated by arrow 64 relative to the golf ball 11. Such a position is referred to as being in front of the golf ball 11 along the path the golf ball 11 will initially travel upon being struck by the face 24 of the putter head 20. Accordingly, the golfer can adjust his or her position in a lateral direction opposite arrow 64 relative to the golf ball 11 to observe the first and second lateral indicators 54, 60 in alignment with each other.

It is worth noting that the golfer's position in the longitudinal direction in FIGS. 6 and 7 is suitable for achieving the desired viewpoint of the golf ball 11. This is indicated by the substantial alignment of the first and second longitudinal indicators 52, 58, which appear to be a single marker as viewed by the golfer.

Similar to the preceding discussion, the golfer can also determine whether an adjustment of his or her position in the longitudinal direction is warranted to achieve the desired viewpoint. In viewing the putter head 20 in FIG. 8, the golfer can determine that he or she is adequately positioned in the lateral direction to achieve the desired viewpoint as indicated by the alignment of the first and second lateral indicators 54, 60. However, the golfer can determine that he or she is separated too far away from the golf ball 11 in a longitudinal direction indicated by arrow 66 to achieve the desired viewpoint of the golf ball 11 by viewing the longitudinal offset of the second longitudinal alignment indicator 58 from the first longitudinal alignment indicator 52. Upon viewing the longitudinal offset such as that shown in FIG. 8, the golfer can adjust his or her position relative to the golf ball 11 and putter head 20 resting on the putting surface 15 in a direction opposite to that indicated by arrow 66, thereby bringing the first and second longitudinal alignment indicators 52, 58 into alignment. When alignment of the first and second longitudinal indicators 52, 58 occurs, the golfer can determine that he or she is positioned in the longitudinal direction relative to the golf ball 11 and putter head 20 to achieve the desired viewpoint of the golf ball 11.

The golfer can also realize that he or she is improperly aligned in the longitudinal direction indicated by arrow 68, thereby causing the golfer's eyes to be positioned beyond the golf ball 11. In such situations, the golfer is standing too close to the golf ball 11 in a longitudinal direction, and must adjust his or her position in a longitudinal direction opposite that indicated by arrow 68. When the golfer's position has been suitably adjusted in the longitudinal direction opposite to that indicated by arrow 68 a sufficient distance, the golfer will observe alignment of the first and second longitudinal alignment indicators 52, 58, causing them to appear to be a single marking.

Figure 10:
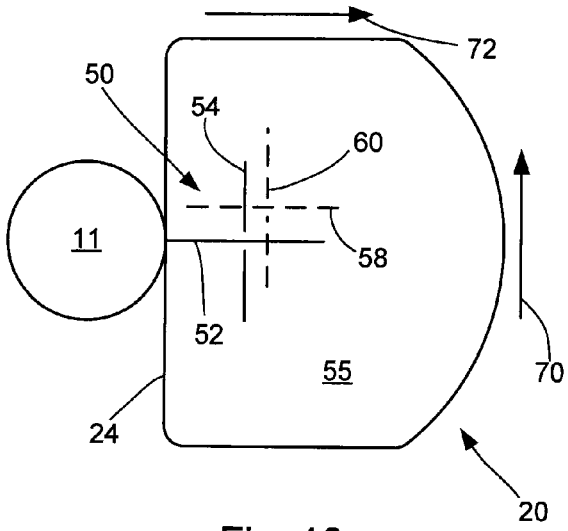
FIG. 10 shows a top surface of a putter head illustrating an example of a visual indicator indicating to a golfer that a desired viewpoint of a golf ball on a putting surface has not been achieved, and that adjustment of the golfer's position relative to the golf ball in both a lateral direction and a longitudinal direction is required to achieve the desired viewpoint.
Figure 11:
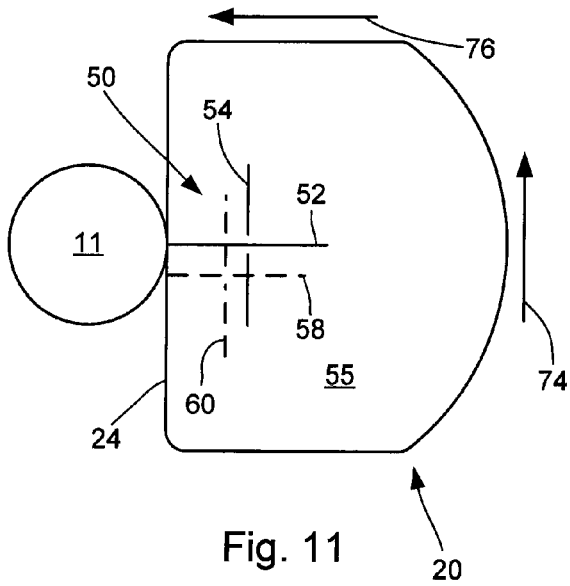
FIG. 11 shows a top surface of a putter head illustrating an example of a visual indicator indicating to a golfer that a desired viewpoint of a golf ball on a putting surface has not been achieved, and that adjustment of the golfer's position relative to the golf ball in both a lateral direction and a longitudinal direction is required to achieve the desired viewpoint.

FIGS. 10 and 11 illustrate examples where the golfer's position is to be adjusted in both a longitudinal direction and a lateral direction to afford the golfer the desired viewpoint of the golf ball 11. As shown in FIG. 10, the second longitudinal alignment indicator 58 appears to the golfer to be offset from the first longitudinal alignment indicator 52 in a longitudinal direction indicated by arrow 70. Likewise, the second lateral alignment indicator 60 appears to the golfer to be offset from the first lateral alignment indicator 54 in a lateral direction indicated by arrow 72. Thus, the golfer is standing too close to the golf ball 11 in the longitudinal direction, and behind the ball in the lateral direction. To bring the first longitudinal and lateral alignment indicators 52, 54 into alignment with the second longitudinal and lateral alignment indicators 58, 60 and afford the golfer the desired viewpoint of the golf ball 11, the golfer's position relative to the golf ball 11, and accordingly the putter head 20, is to be adjusted in both longitudinal and lateral directions opposite arrows 70 and 72, respectively.

Similarly, FIG. 11 illustrates a situation where the golfer's position relative to the golf ball 11 and putter head 20 are to be adjusted in both the longitudinal and lateral directions to bring the indicators 52, 54, 58, 60 into alignment, but in the opposite directions required to bring the indicators 52, 54, 58, 60 into alignment in FIG. 10. As shown in FIG. 11, the visual indicator 50 allows the golfer to determine that he or she is positioned in the longitudinal direction indicated by arrow 74 too far away from the golf ball 11, and in the lateral direction indicated by arrow 76 in front of the golf ball 11. Again, the terms in front of the golf ball 11 and behind the golf ball 11 refer to the position of the golfer's eyes relative to the golf ball 11 as it travels along the path initially after being struck by the face 24 of the putter head 20. To bring the first longitudinal and lateral alignment indicators 52, 54 into alignment with the second longitudinal and lateral alignment indicators 58, 60 and afford the golfer the desired viewpoint of the golf ball 11, the golfer's position relative to the golf ball 11, and accordingly the putter head 20, is to be adjusted in both longitudinal and lateral directions opposite arrows 74 and 76, respectively.

Figure 12:
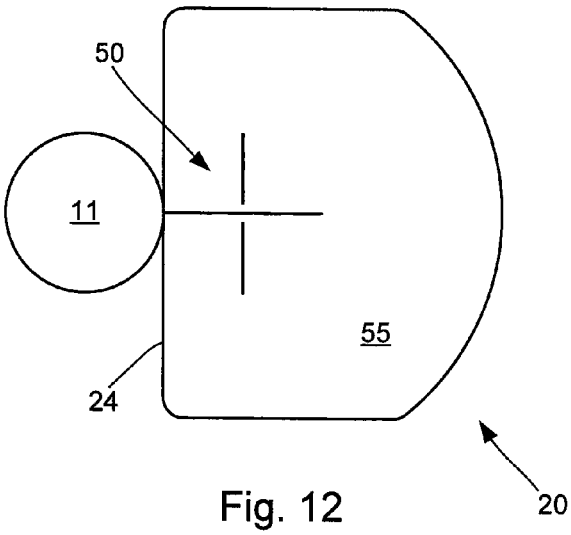
FIG. 12 shows a top surface of a putter head illustrating an example of a visual indicator indicating to a golfer that a desired viewpoint of a golf ball on a putting surface has been achieved.

Once the golfer's position has been adjusted in at least one of the longitudinal direction and a lateral direction relative to the putter head 20 and golf ball 11 to afford the golfer the desired viewpoint of the golf ball before putting the golf ball, the first longitudinal and lateral alignment indicators 52, 54 are aligned with the second longitudinal and lateral alignment indicators 58, 60, respectively, appearing as a single crosshair as shown in FIG. 12. From the desired viewpoint of the golf ball 11, the golfer observes the first longitudinal and lateral alignment indicators 52, 54 substantially concealing the second longitudinal and lateral alignment indicators 58, 60. While putting with the putter 10 of the present invention, the golfer can also determine if there are other problems at various times throughout the putting motion. For example, during the backswing and while bringing the putter head 20 forward as is common in putting the golf ball 11, the golfer will strive to maintain the overlap between the lateral and longitudinal alignment indicators 52, 54, 58, 60 indicating the desired viewpoint of the golf ball 11 as shown in FIG. 12. If, at any time during the putting swing the golfer can observe the second longitudinal alignment indicator 58, the second lateral alignment indicator 60, or both the second longitudinal and lateral alignment indicators 58, 60, then the golfer will realize that there is a flaw in his swing. For example, the golfer may realize that there is a breakdown in his wrists at some point during the putting motion, causing the putter 10 to rotate in a motion other than as a pendulum with the golfer's upper body.

For the embodiments where the golf club 10 is a putter, the desired viewpoint is achieved when the golfer's view of the golf ball is aligned in both the longitudinal direction and the lateral direction to provide a substantially vertical view down onto the golf ball when the golfer is positioned to putt the golf ball. However, as previously mentioned, the visual indicator can be adapted to suitably position the golfer relative to the golf ball 11 to afford the golfer a desired viewpoint of the golf ball 11 for any golf club. Further, the visual indicator 50 can optionally include one or more alignment indicators as required to position the golfer in the longitudinal direction, the lateral direction, or both the longitudinal and lateral directions.

Figure 13:
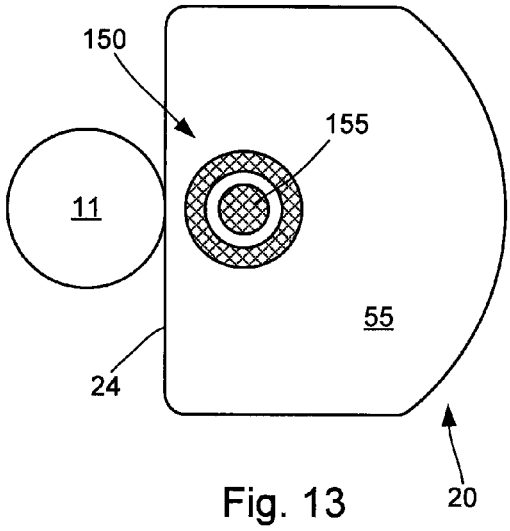
FIG. 13 shows a top surface of a putter head illustrating another example of a visual indicator for indicating whether a desired viewpoint of a golf ball has been achieved to a golfer.

In the preceding discussion, it was explained that alignment of the longitudinal and lateral alignment indicators was indicative of the golfer being in a proper position to obtain a desired viewpoint of the golf ball 11. However, the present invention is not limited to alignable markings that, when viewed from the desired viewpoint appear to be overlapping, provided to the putter head 20. Instead, any visual indicia can be employed to indicate when the golfer becomes properly positioned relative to the ball and/or putter head 20 to obtain a desired viewpoint of the golf ball 11. For example, FIG. 13 illustrates a visual indicator 150 visible exposed at the top surface 55 of the putter head and visible by the golfer to indicate when the golfer is positioned to achieve a desired viewpoint of an adjacent golf ball 11. As shown, the visual indicator 150 includes a circular marking 155 having a holographic type appearance that is visible from a first angle but not clearly visible when viewed from a second angle. According to such an embodiment, the golfer can observe the pattern or object when viewed from the desired viewpoint of the golf ball 11 when the putter head 20 is resting on the putting surface 15 adjacent to the golf ball 11. Yet other embodiments include any type of visual indicator provided to a club head that is viewable by a golfer when the club head is resting on the ground adjacent to a golf ball to indicate to the golfer when he or she has achieved a desired viewpoint of the golf ball. Any of the embodiments can also include the visual indicator 50 or any other feature in a manner such that the putter 10 is compliant with rules and regulations promulgated by the United States Golf Association ("U.S.G.A."). As such, the putter 10 can be used during competitive golf events where compliance with U.S.G.A. rules and regulations is mandated.

Figure 14:
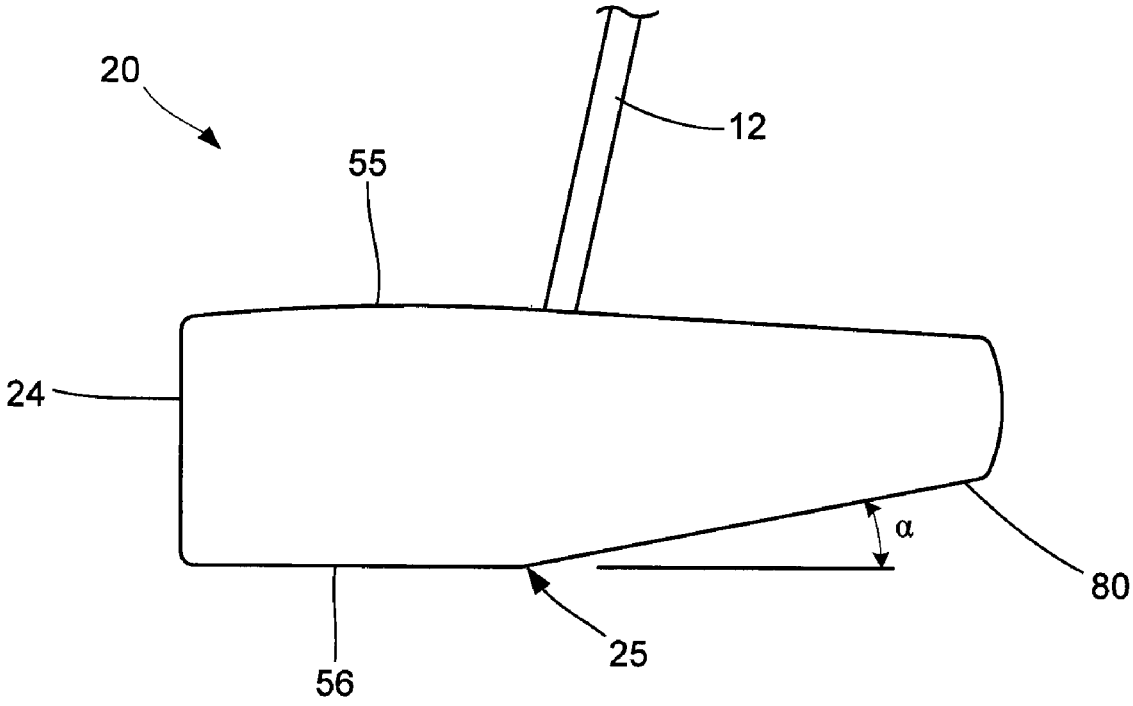
FIG. 14 shows a side view of a putter head including an angled region that forms an angle relative to a flat region.

FIG. 14 shows a side view of the putter head 20. As shown, the flat region 56 provided to the bottom surface 25 establishes a reference orientation of the putter head 20 when the flat region 56 is rested flat on the putting surface 15. The bottom surface 25 of the putter head 20 shown in FIG. 5 can also optionally include an angled region 80 that forms an angle .alpha. relative to the flat region 56. Thus, when the flat region 56 is rested upon the putting surface 15, the angled region 80 gradually rises above the putting surface 15 corresponding to the angle .alpha. The angled region 80 can be substantially planar, or can be somewhat arcuate. Likewise, optional angled side regions 82 can also be substantially planar or somewhat arcuate, and for embodiments such as that shown in FIG. 5, the bottom surface 25 can have an appearance that resembles three sides of a pyramide that is truncated to form the flat region 56, with the face 24 forming the forth side. It is worth noting that the flat region 56 is not necessarily perfectly flat. Instead, alternate embodiments can include feet (not shown), spacers or other features that separate the putter head 20 from the putting surface 15 when the putter head 20 is rested thereon to properly orient the putter head 20.

Figure 15:
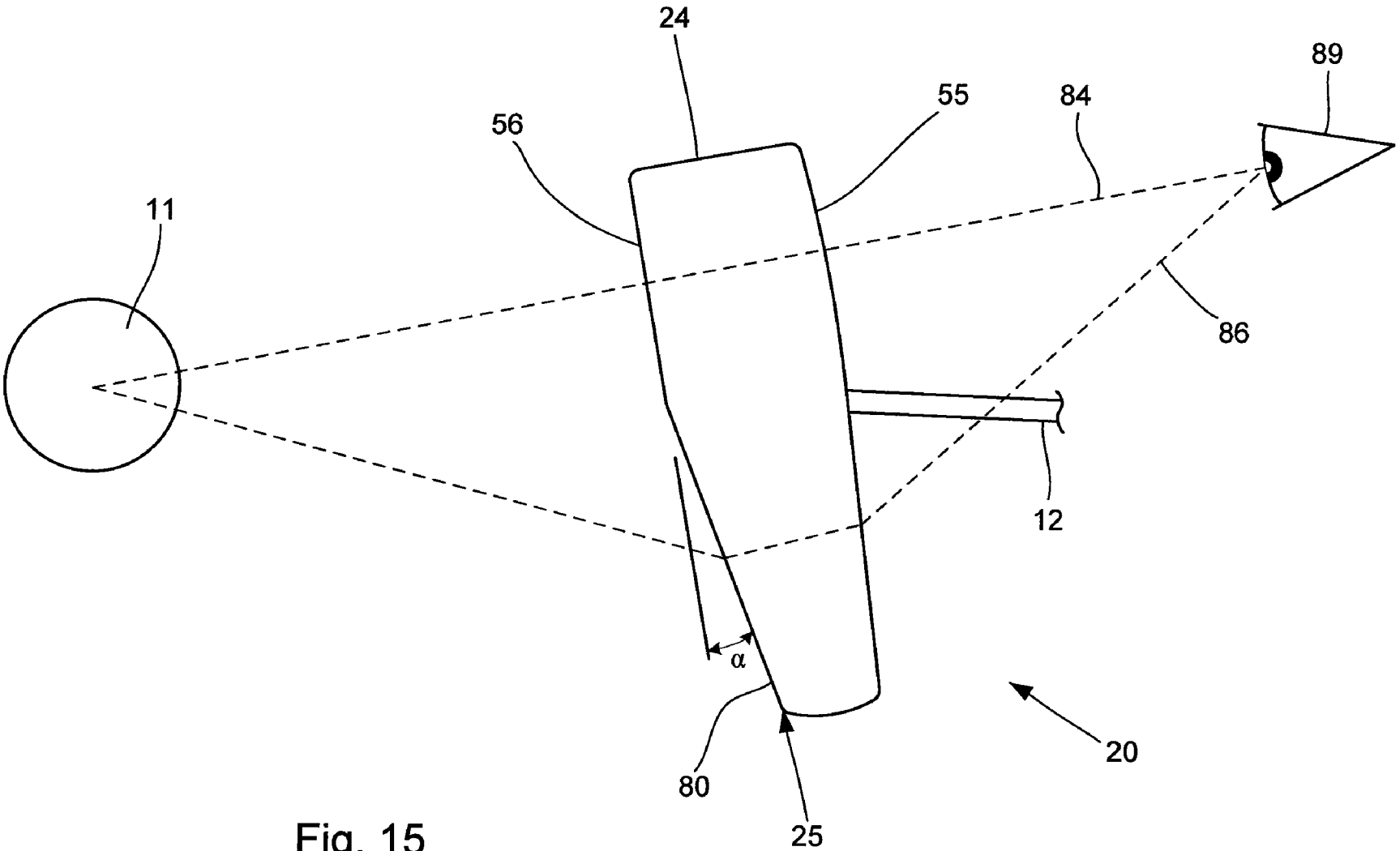
FIG. 15 shows a putter head held by a golfer in a position relative to the golfer's eyes that allows the golfer to observe at least one image of the golf ball displayed by reflecting, refracting or otherwise directing light reflected by the golf ball with a substantially transparent portion of the putter head.

The orientation of the angled region 80 relative to the flat region 56 can also optionally provide the substantially transparent portion of the putter head 20 with an optical property that allows a golfer to simultaneously observe at least one, and optionally a plurality of images of the golf ball 11 when viewed through the substantially transparent portion of the putter head 20. As shown in FIG. 15, the putter head 20 can be held by the golfer in a position that allows the golfer to observe at least one image of the golf ball 11 displayed by reflecting, refracting or otherwise re-directing light reflected by the golf ball 11. As shown in the embodiment illustrated in FIG. 15, the putter head 20 is elevated with the face 24 aimed vertically upward within the golfer's direct line of sight 84 of the golf ball 11 such that the golfer can look directly through the substantially transparent portion of the putter head 20 to observe the golf ball 11 on the other side of the putter head 20. In other words, the golfer's direct line of sight 84 according to an embodiment of the invention provides the golfer with a substantially undistorted view of the golf ball 11 through the transparent portion of the putter head 20 in a manner analogous to looking at the golf ball 11 through a window. Although this view is substantially undistorted, the golf ball 11 as observed through the substantially transparent portion of the putter head 20 may exhibit minimal distortion owing to the optical properties such as the index of refraction of the substantially transparent material.

With the putter head 20 positioned in the golfer's direct line of sight 84 as shown in FIG. 15, the angled region 80 of the bottom surface 25 causes an image of the golf ball 11 to be reflected, refracted or otherwise directed to be displayed to the golfer along a second line of sight 86, different than the direct line of sight 84. The second line of sight 86 optionally provides the golfer with an indirect view of the golf ball 11 at the same time the golfer can view the golf ball 11 along the direct line of sight 84. The transparent portion of the putter head 20 can optionally direct light reflected by the golf ball 11 to be viewed along the second line of sight 86, which is different than the direct line of sight 84 along which the golf ball 11 can be observed through the substantially transparent portion of the putter head 20.

Although the golfer's view of the golf ball 11 is described above as including a direct view of the golf ball 11 along a direct line of sight 84 and an indirect view of the golf ball 11 resulting from redirection of light reflected by the golf ball 11 along a second, indirect line of sight 86, the present invention is not so limited. For example, the golfer can optionally observe two indirect views of the golf ball 11 along two indirect lines of sight resulting from redirection of light reflected by the golf ball 11 by the substantially transparent portion of the putter head 20 according to alternate embodiments.

Figure 16:
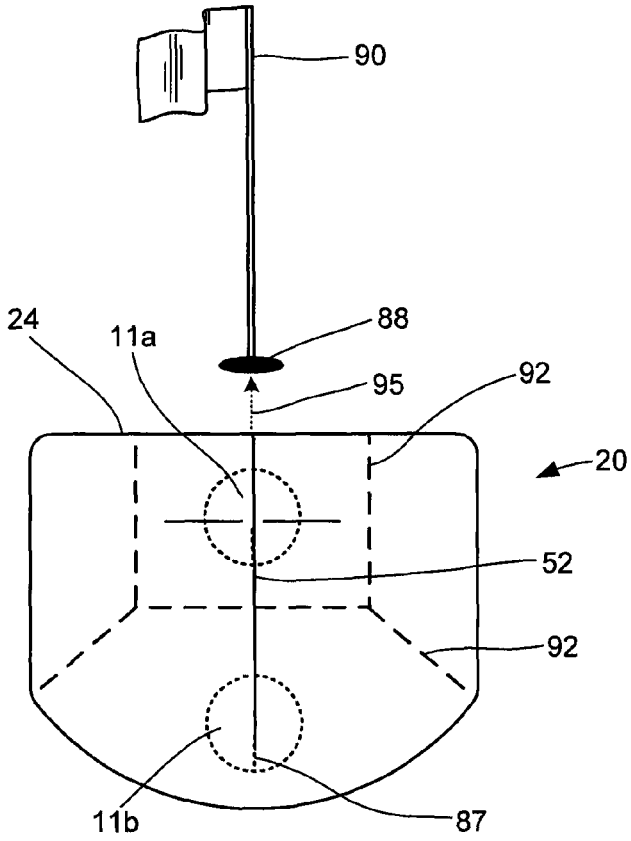
FIG. 16 shows an example of a golfer's view of two images of a golf ball observed with a substantially transparent portion of a putter head, wherein the golfer can aim the golf ball in a desired direction to make a putt on a flat putting surface.
Figure 17:
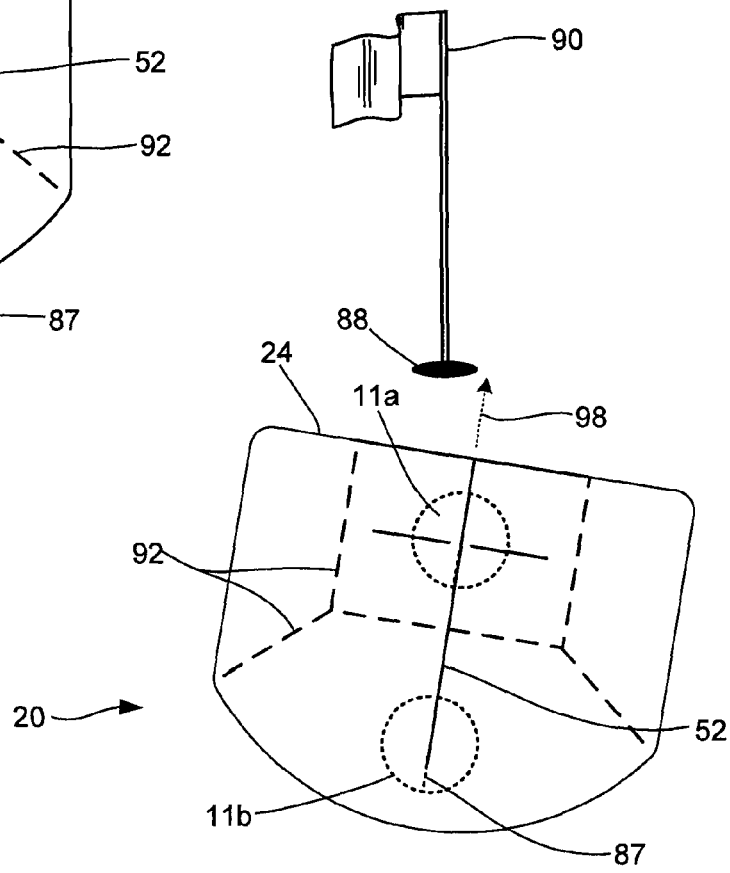
FIG. 17 shows an example of a golfer's view of two images of a golf ball observed with a substantially transparent portion of a putter head, wherein the golfer can realize that the golf ball is aimed in an undesired direction to make a putt on a flat putting surface.

For the embodiments where, as in FIG. 15, the golfer can observe the golf ball 11 along a direct line of sight 84 and at least one indirect line of sight 86, the golfer can aim the golf ball 11 to travel in a desired direction. When the putter head 20 is elevated by the golfer to observe the golf ball 11 along the direct line of sight 84 and the indirect line of sight 86, the golfer can simultaneously observe two views of the same golf ball 11 as shown in FIG. 16. Alternate embodiments can include a putter head 20 provided with more than one angled region 80 to produce any desired number of indirect images of the golf ball 11. As shown in FIGS. 16 and 17, the golf ball 11 being viewed through the putter head 20 includes a straight line 87 drawn thereon to aid in aiming the golf ball 11 towards the target, which in this case is the hole 88 formed in the putting surface 15, marked by the flag 90. When the golf ball 11 bearing the straight line 87 is placed on the putting surface 15, the golf ball 11 is oriented such that the line is aimed at the hole 88. If the golfer strikes the golf ball 11 with the face 24 of the putter head 20 and causes the golf ball 11 to travel in the direction indicated by the straight line 87, the golf ball 11 should travel in a path that intersects with the hole 88.

The perspective in FIG. 16 is that of the golfer when the putter head 20 is held in the position shown in FIG. 15 relative to the golfer's eyes 89, looking through the top surface 55 of the putter head 20. The golf ball 11 and lines 92 marking the boundaries of the flat region 56 and angled region 80 are shown in FIG. 16 with broken lines as being viewed through the top surface 55 of the putter head 20. For the sake of clarity, the golf ball 11 observed by the golfer along the direct line of sight 84 will be referred to as golf ball image 11 a and the golf ball 11 observed by the golfer along the indirect line of sight 86 will be referred to as golf ball image 11*b*.

With the two golf ball images 11*a*, 11*b* visible to the golfer, the golfer can adjust the position of the putter head 20 to align the first longitudinal alignment indicator 52 or other such visible marking provided to the putter head 20 with the line 87 appearing on the golf ball images 11*a*, 11*b*. As shown in FIGS. 16 and 17, the first longitudinal indicator 52 is elongated to extend substantially across the entire top surface 55 of the putter head 20 when viewed by the golfer from the perspective looking through the top surface 55 of the putter head 20 as shown in FIGS. 15-17. When the first longitudinal indicator 52 is aligned with the line 87 appearing on each of the two golf ball images 11*a*, 11*b*, the golfer can mentally extrapolate the first longitudinal indicator 52 beyond the face 24 of the putter head 20. The mentally extrapolated first longitudinal indicator 52 provides the golfer with a sense of the path along which the golf ball 11 is aligned, as indicated by the straight line 87.

FIG. 16 illustrates an example where the straight line 87 provided to the golf ball 11 was oriented to point directly toward the center of the hole 88 when placed on the putting surface 15. If the golfer strikes the golf ball 11 with the face 24 of the putter head 20, causing the golf ball 11 to initially travel along the path indicated by the straight line 87, the golf ball 11 will travel directly toward the hole 88, assuming the putting surface 15 is flat and there are no external influences on the golf ball 11. This projected path indicated by the straight line 87 and along which the golf ball 11 will initially travel is shown in FIG. 16 by the arrow 95, and can be visualized by the golfer by mentally extrapolating the first longitudinal indicator 52 when the first longitudinal indicator 52 is aligned with the golf ball images 11*a*, 11*b* as described above.

In contrast, FIG. 17 illustrates and example where the golfer erroneously aimed the straight line 87 provided to the golf ball 11 to point to the right of the hole 88 when the golf ball 11 was placed on the putting surface 15. If the golfer strikes the golf ball 11 in FIG. 17 with the face 24 of the putter head 20, causing the golf ball 11 to initially travel along the path indicated by the straight line 87, the golf ball 11 will travel along a path that extends to the right of the hole 88, as that direction is shown in FIG. 17, assuming again that the putting surface 15 is flat and there are no external influences on the golf ball 11. This projected path indicated by the straight line 87 and along which the golf ball 11 will initially travel is shown in FIG. 17 by the arrow 98, and can be visualized by the golfer by mentally extrapolating the first longitudinal indicator 52 when the first longitudinal indicator 52 is aligned with the golf ball images 11*a*, 11*b* as described above. Thus, the golfer can realize that the indicator (i.e., the straight line 87) provided to the golf ball 11 to allow the golfer to aim the golf ball 11 toward the hole 88 is not properly aligned with the hole 88 before striking the golf ball 11.

Other embodiments can utilize a single image of the golf ball 11 to be observed by the golfer through the substantially transparent portion of the putter head 20. According to such embodiments, the golfer can align any portion of the visual indicator 50 with the line 87 or other suitable marking provided to the golf ball 11 to observe alignment of the golf ball 11 relative to a target.

Illustrative embodiments have been described, hereinabove. It will be apparent to those skilled in the art that the above devices and methods may incorporate changes and modifications without departing from the general scope of this invention. It is intended to include all such modifications and alterations in so far as they come within the scope of the appended claims.

The invention claimed is:

1. A putter for positioning a golfer when preparing to putt, comprising:

an elongated shaft with a grip thereon for holding the putter;

a putter head on a distal end of said shaft, said putter head having a top, a bottom, a generally planar front face, and sides, said putter head being a generally monolithic block which is transparent over substantially all of said putter head when viewed from above with said putter head resting on a putting surface, and transparent over substantially all of said bottom, front face and sides;

said putter head further having a substantially planar flat surface along at least a major part of said bottom of said putter head, said flat planar bottom surface establishing a predetermined orientation of said putter head, and thereby the putter, relative to the putting surface when placed flat upon the putting surface;

an alignment device formed on said putter head, said alignment device having a part on said top and another part on said bottom, wherein said alignment device is a first circle on said top and a second circle on said bottom, said circles on said top and bottom aligning so that a center of each circle is located at a point approximately center on an imaginary line from a golfer's head directly above the putter when placed flat on the putting surface;

said alignment device parts when aligned with each other so as to yield a single combined image pattern when viewed by a golfer holding the putter with said putter head flat planar bottom surface resting flat on the putting surface adjacent a ball, thereby establishing said predetermined orientation of said putter head and putter.

* * * * *